US007537525B2

(12) United States Patent
Wang

(10) Patent No.: US 7,537,525 B2
(45) Date of Patent: May 26, 2009

(54) GOLF TRAINING DEVICE

(75) Inventor: Qian Wang, King City (CA)

(73) Assignee: Brunton Innovations Inc., Ontario (CA)

( * ) Notice: Subject to any disclaimer, the term of this patent is extended or adjusted under 35 U.S.C. 154(b) by 0 days.

(21) Appl. No.: 11/474,751

(22) Filed: Jun. 26, 2006

(65) Prior Publication Data

US 2007/0298899 A1 Dec. 27, 2007

(51) Int. Cl.
*A63B 69/36* (2006.01)

(52) U.S. Cl. ..... 473/206; 473/226; 473/220

(58) Field of Classification Search ..... 473/201–206, 473/219–223
See application file for complete search history.

(56) References Cited

U.S. PATENT DOCUMENTS 2,628,100 A 2/1953 Beebe
3,227,455 A * 1/1966 Hulsman ..... 473/206
5,897,441 A 4/1999 Apthorp
5,984,795 A * 11/1999 Stafford ..... 473/206
6,705,951 B2 3/2004 Beauregard
6,921,340 B2 7/2005 Dickie
D520,091 S * 5/2006 Leadbetter et al. ..... D21/758

* cited by examiner

*Primary Examiner*—Nini Legesse
(74) *Attorney, Agent, or Firm*—Sand & Sebolt

(57) ABSTRACT

A golf training device for aiding a golfer in perfecting their grip on a golf club and their swing. The golf training device includes an elongated member made from a flexible plastic material and that is designed to frictionally engage the handle portion of the golf club. The device includes a gripping region with first and second positioning aids thereon for correct placement of the golfer's thumbs. The device further includes a pair of lasers that are mounted in a rest area that integrally formed with the gripping region. The lasers are mounted so as to emit a pair of divergent laser beams outwardly away from the lowermost end of the device and on either side of the golf club head. The lasers are used to correctly align the device on the golf club shaft and as an aid for the golfer to check his grip on the club and the position he assumes for addressing a golf ball. The device may further be provided with a third laser mounted on the uppermost end of the gripping region such that the third laser emits a beam of light outwardly from the uppermost end and aligned with the longitudinal axis of the device. The third laser beam is useful for the golfer to train himself to correctly swing the golf club.

21 Claims, 9 Drawing Sheets

GOLF TRAINING DEVICE

BACKGROUND OF THE INVENTION

1. Technical Field

This invention generally relates to golfing devices. More particularly, the invention relates to golf training devices. Specifically, the invention relates to a training device that is frictionally engaged on a golf club handle and includes first and second positioning aids for the golfer's thumbs and a plurality of laser beams that act as visual aids so that the golfer can train himself to correctly hold the club, address a golf ball and swing the club.

2. Background Information

In order to be successful at golf, the golfer needs to master their swing and the point of contact of the golf club face with the golf ball. A golf swing is about two basic issues, namely, how one holds the club and how one moves the club. These two features logically would seem to be combined, and one affects the other in that the grip can affect the swing. If either of these components is missing, the golfer will tend to hook or slice the ball and will not play as well as he possibly could.

Many devices have been proposed in the prior art to aid in teaching the golfer how to grip a golf club in a consistent and correct manner. Still other devices have been proposed to aid in teaching the golfer to consistently and correctly swing the club.

There is still a need in the art for a training aid that will assist in teaching a golfer to combine these two elements and will effectively teach him to both hold and swing the club properly.

SUMMARY OF THE INVENTION

The device of the present invention is a golf training device for attachment to the grip portion of the handle portion at the end of a golf club. The golf training device is useful for aiding a golfer in perfecting both the way they hold the golf club and their swing. The golf training device includes an elongated member made from a flexible plastic material and that is designed to frictionally engage the handle portion of the golf club. The device includes a gripping region that has first and second positioning aids thereon for showing the golfer where to place their thumbs. The device further includes a pair of lasers that are mounted in a rest area that integrally formed with the gripping region on the training device. The lasers are mounted so as to emit a pair of divergent laser beams outwardly away from the lowermost end of the device and on either side of the golf club head. The lasers are used to correctly align the device on the golf club shaft and as an aid for the golfer to check both his grip on the club and the position he assumes for addressing a golf ball. The device may further be provided with a third laser mounted on the uppermost end of the gripping region. The third laser is activated to emit a third laser beam outwardly from the uppermost end of the device. The third laser beam is aligned with the longitudinal axis of the device and is useful for training the golfer to correctly swing the golf club.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

FIG. 11-1 is a perspective view showing the first hand of the golfer placed around the training device and club grip;

FIG. 11-2 is a perspective view showing the first hand of the golfer placed around the training device and club grip and showing the placement of the thumb in the oval aperture and against the placement projection.

DETAILED DESCRIPTION OF THE INVENTION

Figure 1:
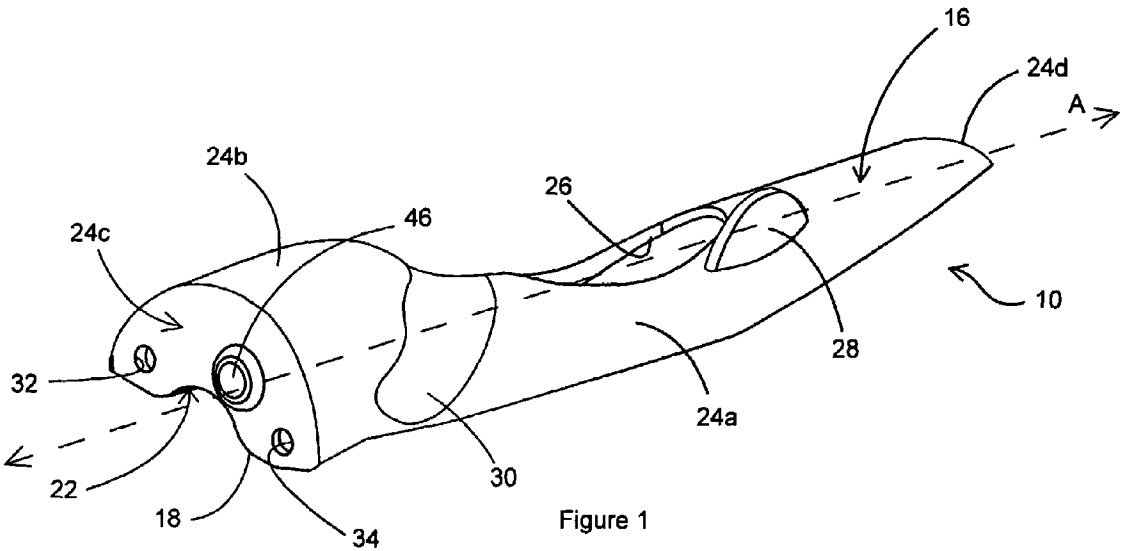
FIG. 1 is a perspective view of a first embodiment of the golf training device in accordance with the present invention.
Figure 2:
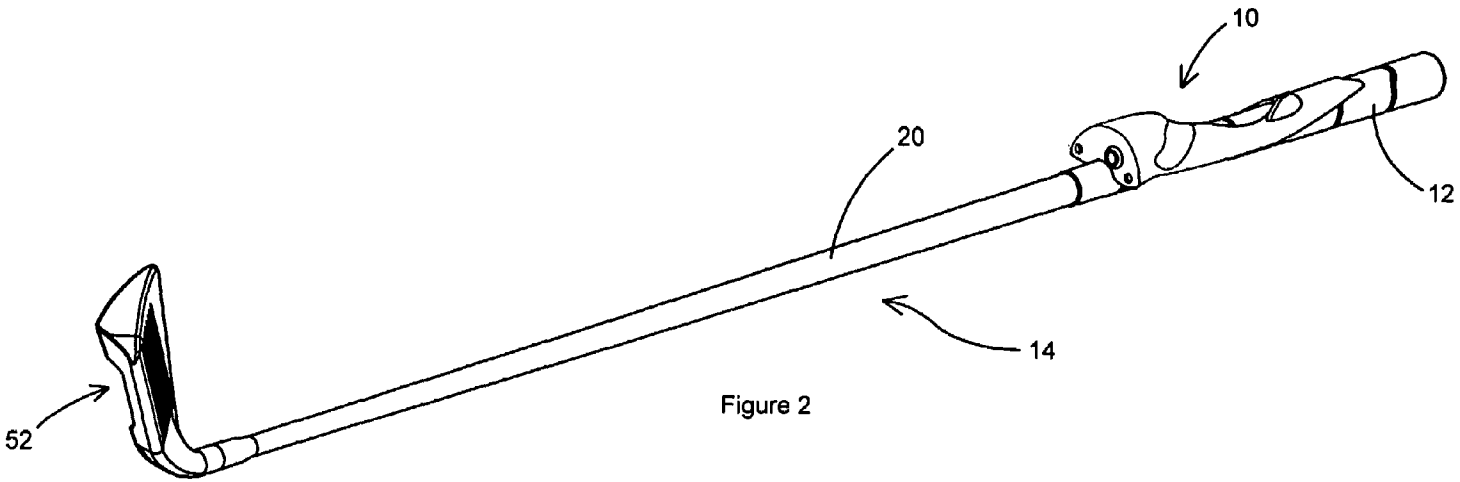
FIG. 2 is a perspective view of the golf training device mounted onto a golf club.
Figure 3:
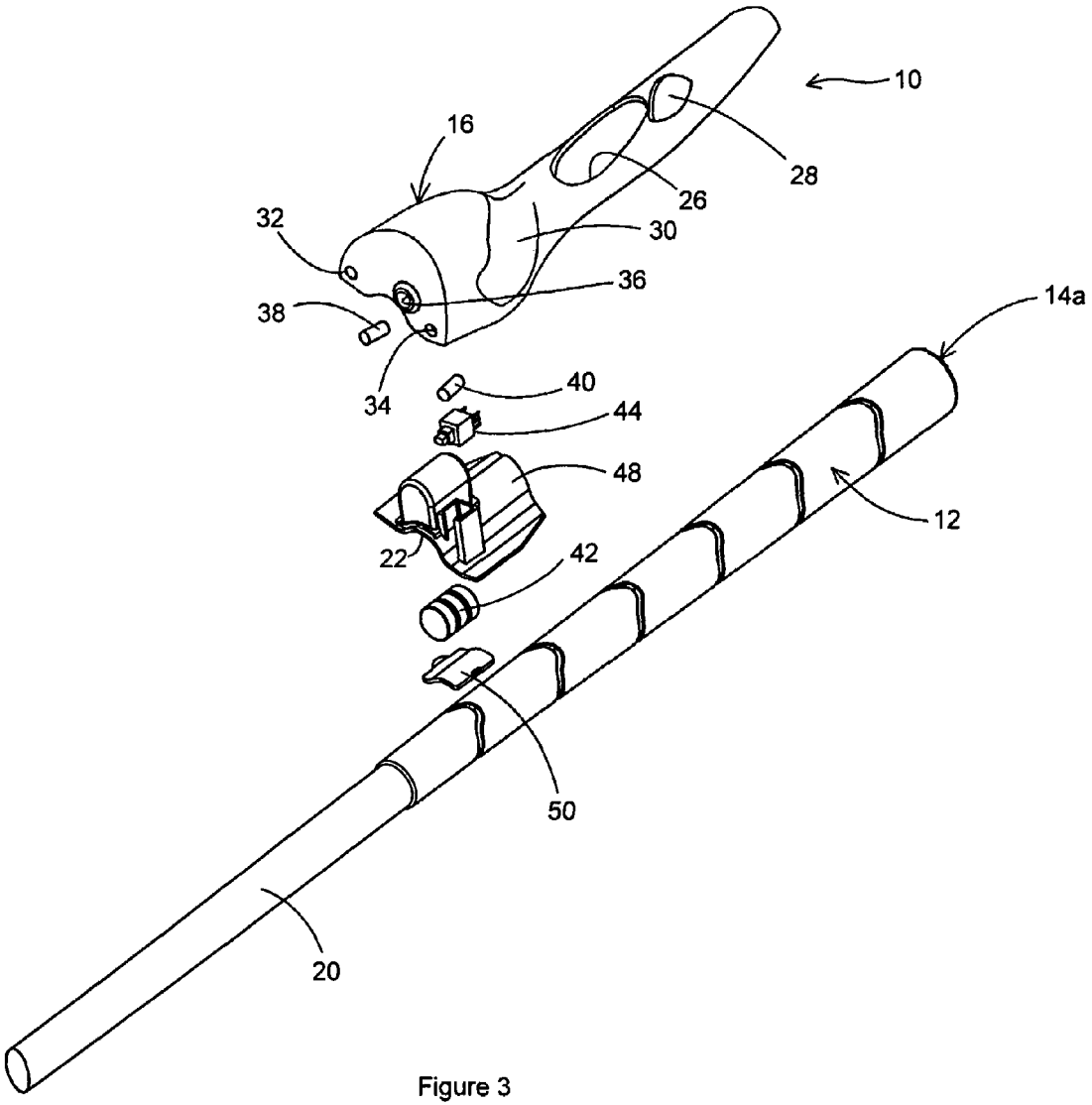
FIG. 3 is an exploded perspective view of the training device and the golf club.
Figure 4:
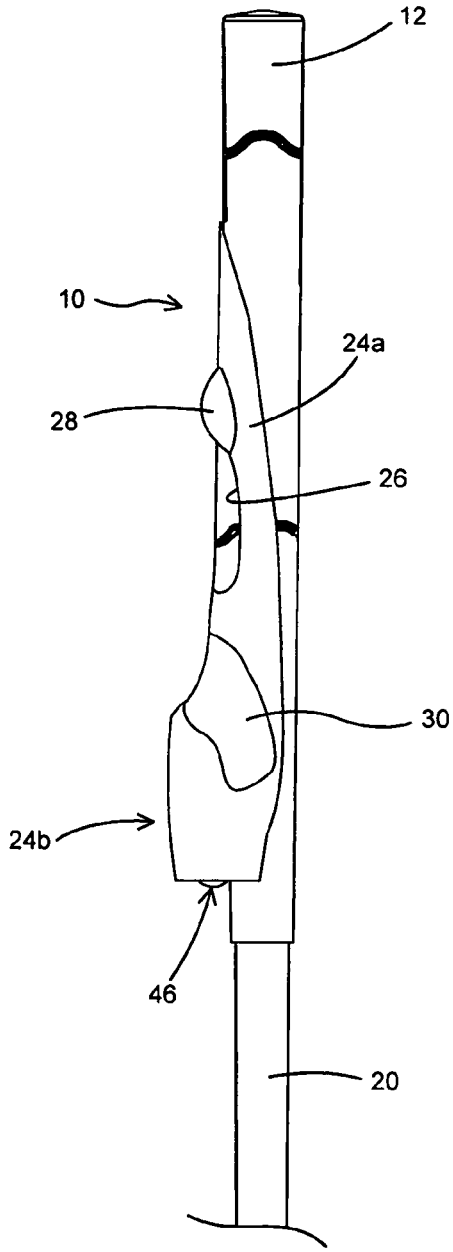
FIG. 4 is a side view of the top of the golf club showing the training device.
Figure 5:
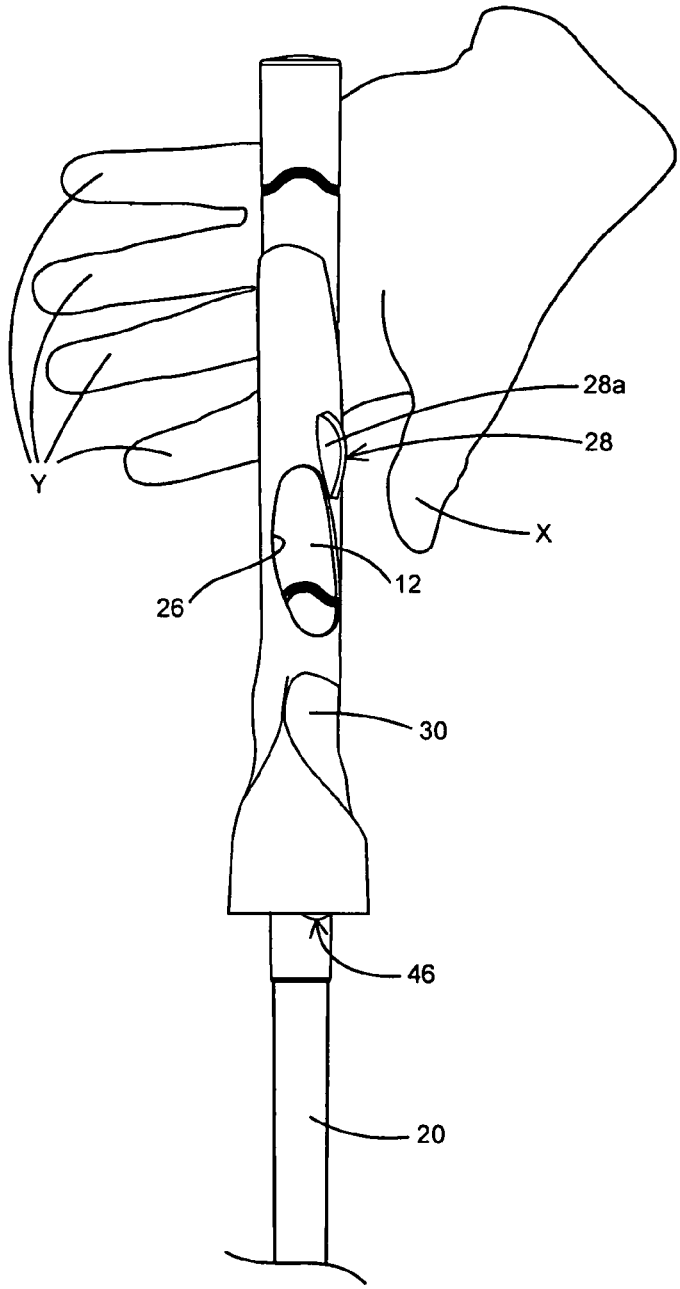
FIG. 5 is a front view of the top of the golf club showing the beginning positioning of the golfer's hand around the training device.

Referring to FIGS. 1-5, there is shown a golf training device in accordance with the present invention and generally indicated at 10. Golf training device 10 is adapted to frictionally engage the handle portion 12 at the end a golf club 14 and to aid in correct placement of the golfer's hands.

Device 10 is dedicated in that it is either molded for use by a right-handed golfer or a left-handed golfer. The device shown in the attached figures is designed for use by a right-handed golfer, but it will be understood by those skilled in the art that a device useful for a left-handed golfer would simply be a mirror image of the device shown in the attached figures.

Device 10 comprises an elongated flexible base 16 that is molded from any suitable material that can frictionally engage the rubber of the handle portion 12 on the end of a shaft 20 of a standard golf club 14. One such suitable material for base 16 is a plastic such as polypropylene. Base 16 has a bottom surface 18 that is shaped to receive the tapering convex profile of handle 12 therein. Consequently, bottom surface 18 of base 16 includes a complementary shaped concave channel 22 that tapers from the top end 24*d* of base 12 to the bottom end 24*c* thereof.

The upper surface 24 of base 16 is molded in such a manner that it will cause a golfer to correctly grasp club 14. Upper surface 24 includes a gripping region 24*a* and a rest region 24*b*. Rest region 24*b* is thicker than gripping region 24*a*, and the latter tapers in thickness so that at its uppermost end 24*d* it is substantially flush with handle 12. Gripping region 24*a* includes an elongated oval aperture 26 into which the golfer will place the thumb of his uppermost hand. Aperture 26 is generally aligned with the longitudinal axis "A" of base 16. A substantially semicircular stop 28 extends outwardly away from the outer surface of gripping region 24*a*. Stop 28 includes a substantially flat inner surface 28*a* (FIG. 5) along which an inner side of the golfer's thumb rests. Stop 28 aids in preventing lateral motion of the golfer's thumb out of aperture 26, and thereby keeps the thumb. "X" correctly seated therein. Stop 28 also aids in preventing base 16 from rotating within the golfer's hand as he plays his stroke.

A groove 30 is molded into the upper portion of rest region 24*b* proximate gripping region 24*a*. Groove 30 is disposed at an acute angle relative to the longitudinal axis "A" of base 16 and is provided for correct placement of the thumb of the golfer's lower hand. Groove 30 angles downwardly toward the lowermost end 24*c* of base 16. The thicker, raised rest region 24*b* prevents inadvertent downward movement of the golfer's lower hand as he plays his stroke and provides for a comfortable gripping surface for the golfer's hand.

Rest region 24*b* is substantially hollow and acts as the housing for all the electronic components of device 10. Rest region 24*b* is substantially semicircular in cross section (FIG. 1) and is raised relative to gripping region 24*a* (FIG. 4) when device 10 is engaged with the handle 14. The lowermost end 24*c* of base 16 is substantially flat and is provided with a pair of spaced-apart apertures 32, 34 that are located on either side of a third aperture 36. A pair of lasers 38, 40 (FIG. 3) are retained within the interior of rest region 24*b* and each laser is designed to shine a beam of light outwardly through one of apertures 32, 34. Lasers 38, 40 are low powered lasers that are positioned so as to emit divergent laser beams. Lasers 38, 40 are powered by one or more batteries 42 which are activated by depressing a switch 44. Switch 44 projects partly outwardly through aperture 36 in lowermost end 24*c* of base 16 and is covered by a rubber button 46. Button 46 is depressed to either activate or deactivate lasers 38, 40. Bottom surface 18 of base 16 includes a cover portion 46 that protects all of these components but can be removed for replacement of lasers 38, 40 and switch 44. Cover portion 46 is provided with a hole (not shown) through which battery 42 can be accessed for replacement. A battery cover 48 is provided to cover the hole and retain battery 42 within the interior of rest region 24*b*. Cover portion 46 is formed with a portion of concave channel 22 therein.

Figure 6:
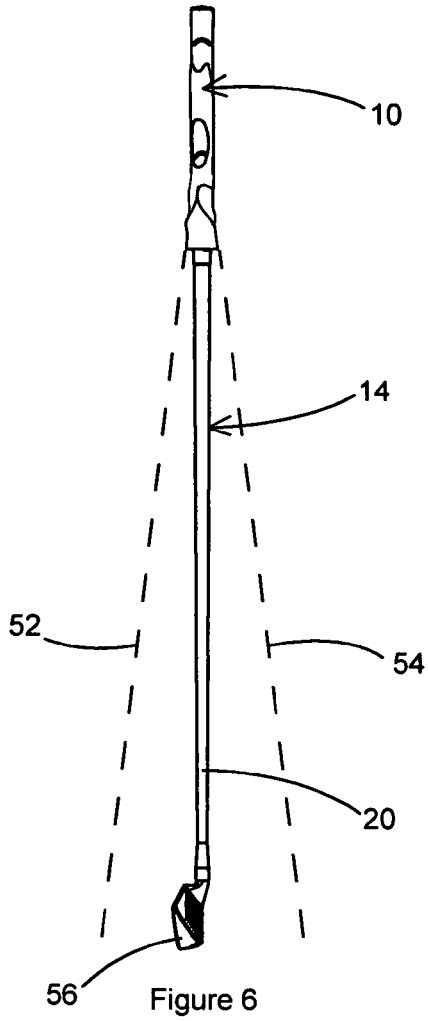
FIG. 6 is a front view of the golf training device and golf club showing the divergence of the two lower lasers.

Golf training device 10 is used in the following manner. The golfer grasps base 16 and, positioning the top end 24*d* of base 16 proximate the area where the handle portion 12 joins the shaft 20 on the club 14, slides base 16 upwardly toward the top 14*a* of club 14. Channel 22 slightly expands as it slides upwardly over handle portion 12 and thereby base 16 is caused to frictionally engage handle portion 12. When no further sliding motion is possible between device 10 and handle portion 12, the device 10 tends to be positioned between 2" and 2½" inches from the top 14*a* of club 14. The positioning of device 10 can be checked by activating lasers 38, 40, as hereinafter described, making sure that beams 52, 54 of laser light emitted from device fall on either side of the head 56 of club 14 (FIG. 6); and that they are emitted generally equidistant from shaft 20 of club 14.

Figure 7:
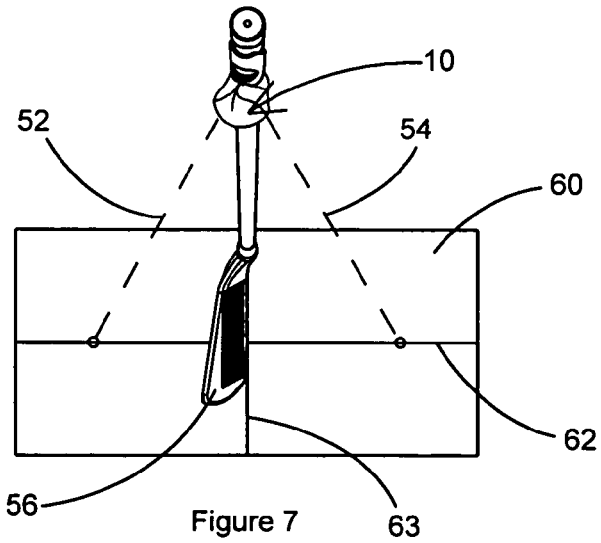
FIG. 7 is a top view of the golf training device and golf club showing the position of the lasers on a practice mat that is marked with a line.

Device 10 is designed to be used in conjunction with a practice mat 60 (FIG. 7) that is substantially similar to the mat disclosed in U.S. Pat. No. 6,921,340 issued to Dickie on Jul. 26, 2005. Referring to FIG. 7 of the instant application, mat 60 includes a first line 62 that lies substantially along the longitudinal axis of mat 60 and a second line 63 that is disposed substantially at right angles thereto. In order to correctly align training device 10 on club 14, the head 56 of club 14 is placed on mat 60 such that the face 57 thereof is aligned with line 63 on mat 60. Training device 10 is rotated on handle portion 12 until the laser beams 52, 54 shine in the manner shown in FIG. 7, i.e., until both beams 52, 54 terminate on line 62 when face 57 of club 14 is aligned with line 63.

Figures 1, 11:
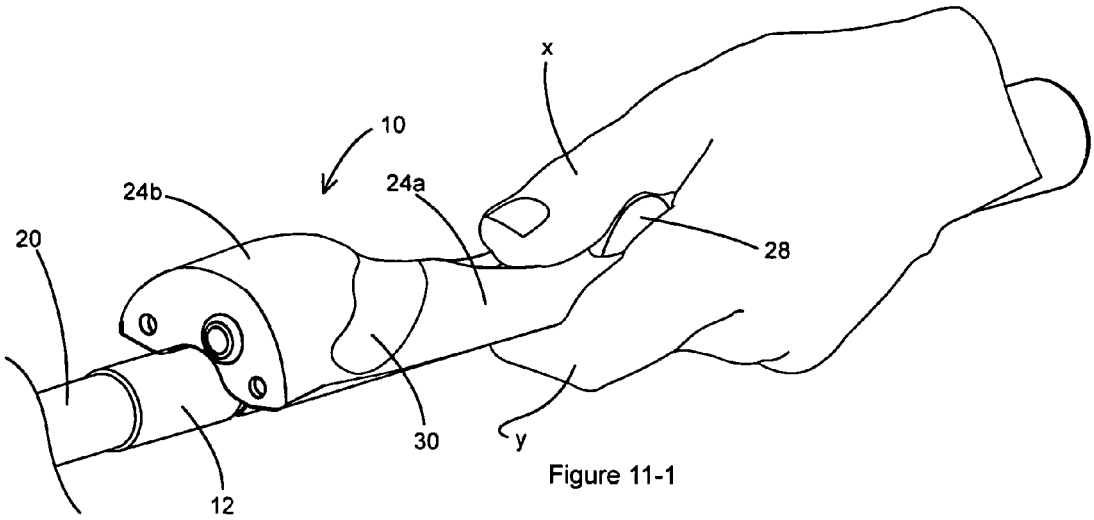
Figures 2, 11:
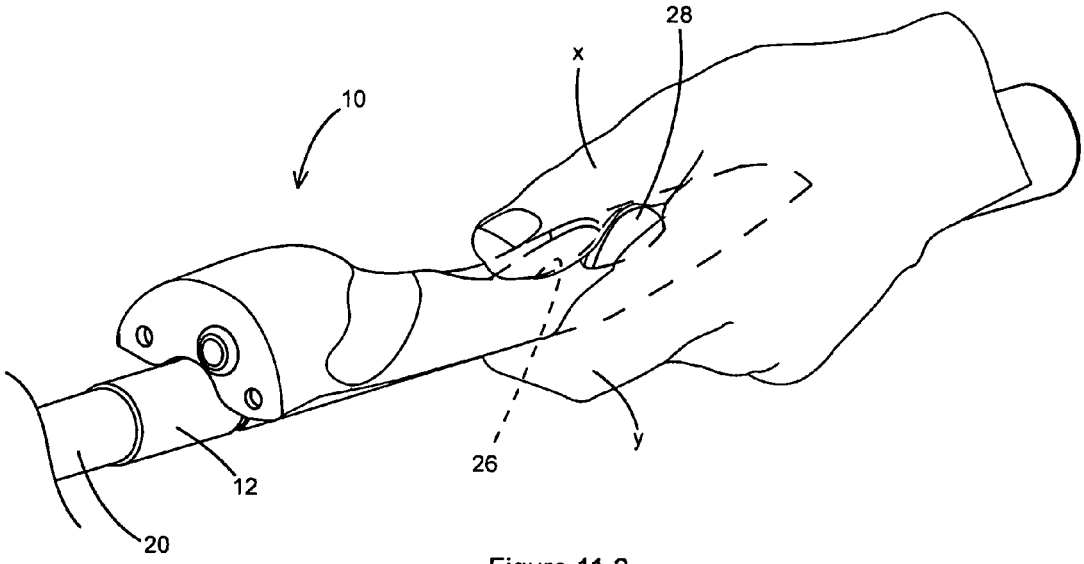
Figure 12:
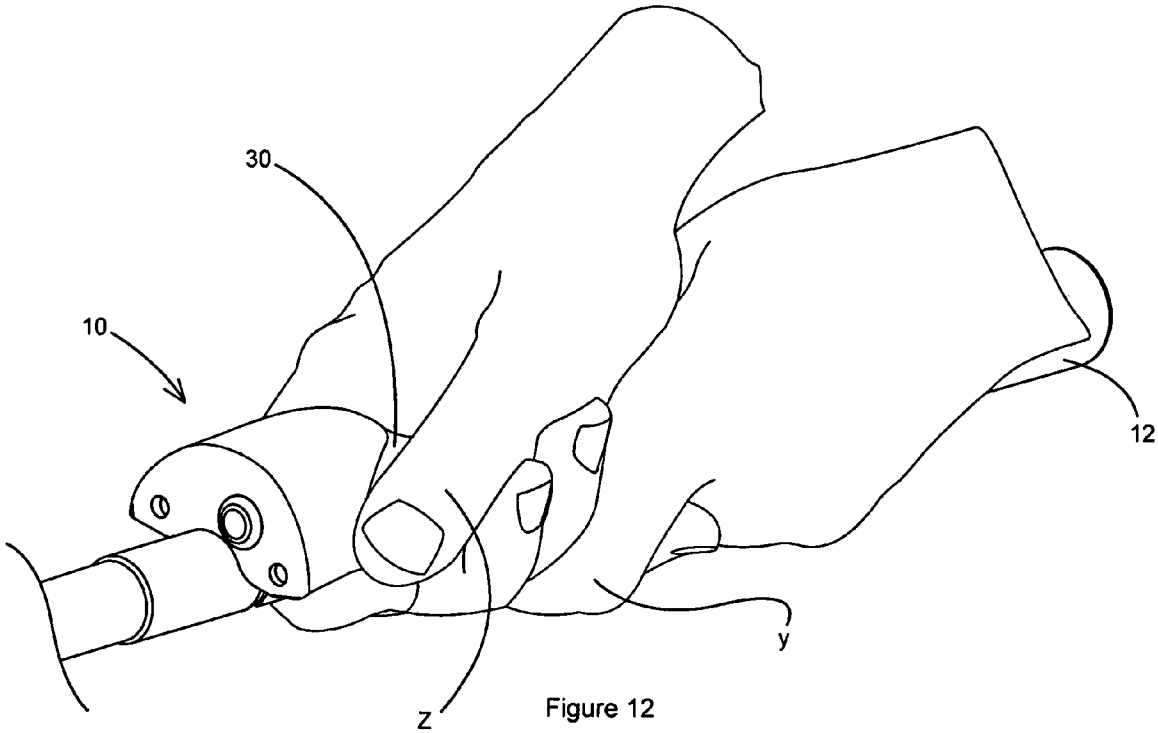
FIG. 12 is a perspective view showing both of the golfer's hands in position around the training device and club grip.

Referring to FIGS. 11-12, club 14 is now ready to be used by the golfer to practice gripping the club 14 correctly. In order to do this, the golfer grasps club 14 and device 10 and positions his thumb "X" in the aperture 26. The inner side of the golfer's thumb "X" rests against stop 28. The golfer then can simply close his fingers "Y" around both handle portion 12 and parts of the gripping region 24*a* of device 10. The golfer positions his other thumb "Z" into groove 30, curls his other fingers around the back of handle portion 12 and interlocks the fingers of both hands together as is commonly done. Consistently positioning his hands in this manner will aid in teaching the golfer to consistently hold the club 14 correctly.

Furthermore, when the golfer is gripping club 14 correctly and he is standing in the correct position to address a golf ball (not shown) on mat 60, with lasers 38, 40 activated, then the divergent beams 52, 54 of laser light will shine onto mat 60. If, however, after the golfer has aligned training device 10 properly, has positioned his hands on device 10 and now stands proximate the mat 60 to address a golf ball, and then finds that one or both of beams 52, 54 do not fall on line 62, then he knows that either he is holding club 14 incorrectly or his feet are in either a toe in or a toe out position. He can then release his grip on club 14 and reposition his hands. If this doesn't work, then he can use the relative positions of the laser beams 52, 54 to aid him in positioning his feet correctly by simply shuffling one or both feet until the laser beams 52, 54 are aligned along line 62. The laser beams 52, 54 therefore act as a visual reference that can be quickly and easily checked by the golfer to ensure that he is both holding the club correctly and addressing the ball correctly. The golfer's muscle memory is trained by repeatedly gripping the club 14 and positioning his body correctly. Thus, over time, the training device 10 will help to improve the golfer's game.

Figure 8:
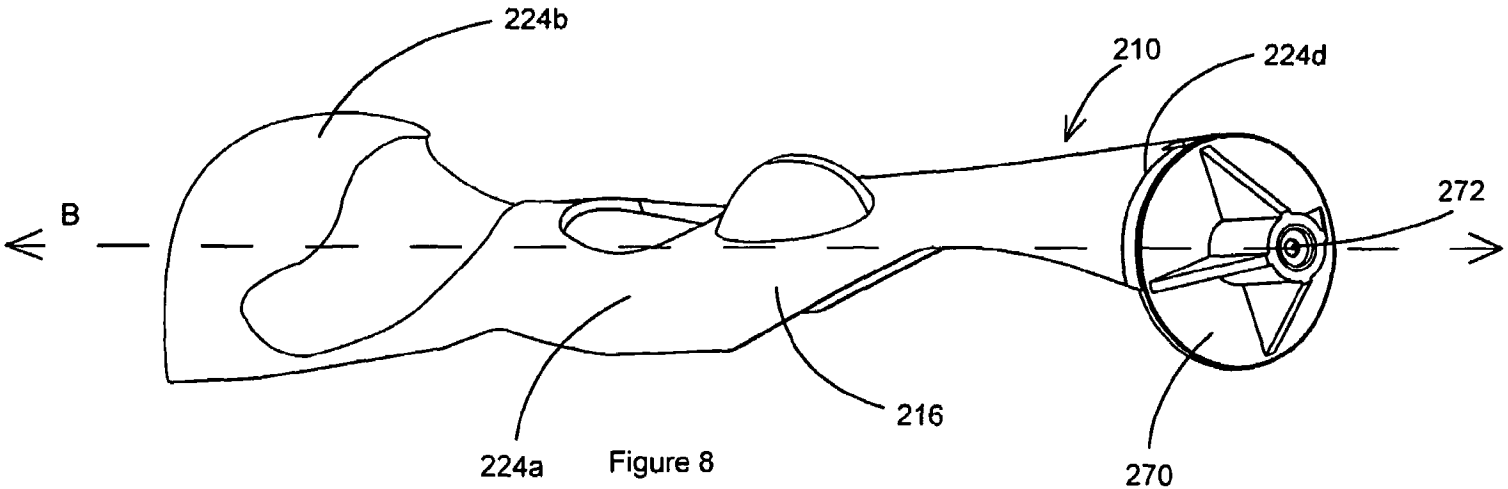
FIG. 8 is a rear perspective view of a second embodiment of the golf training device in accordance with the present invention.
Figure 9:
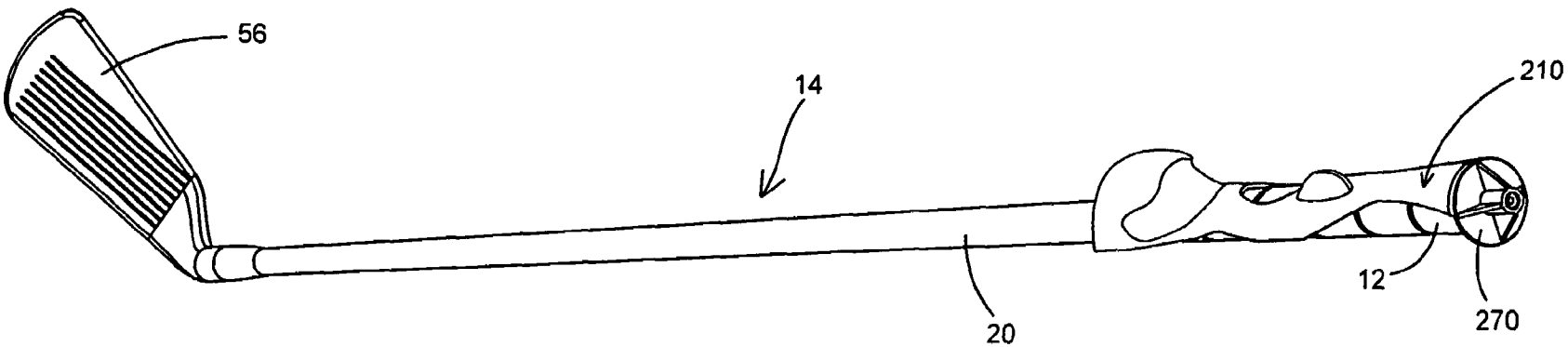
FIG. 9 is a perspective view of the golf training device of FIG. 8 mounted on a golf club.
Figure 9A:
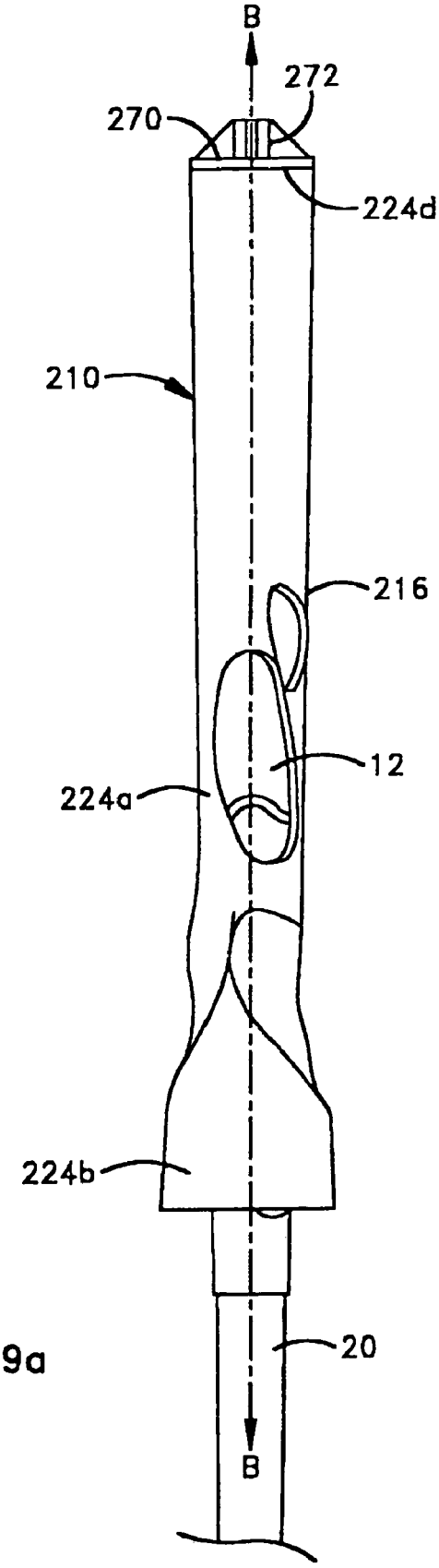
FIG. 9*a* is front view of the golf training device of FIG. 9.
Figure 10:
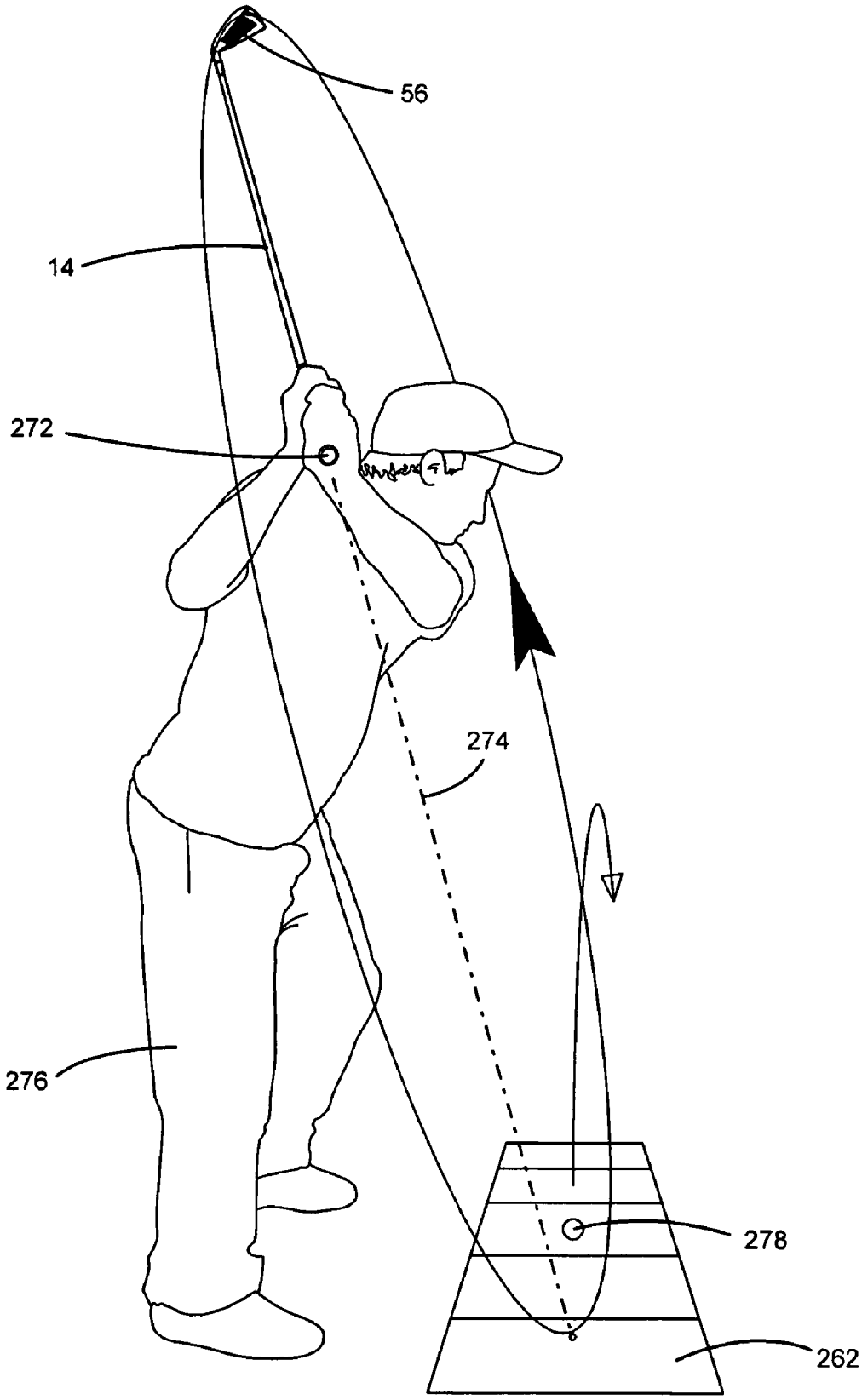
FIG. 10 is front view of a golfer using the golf club and training device in conjunction with a practice mat and showing the positioning of the beam from the topmost laser on the mat.

A second embodiment of the golf training device in accordance with the present invention is shown in FIGS. 8-10 and is generally indicated at 210. Device 210 includes all of the features of device 10, but further includes a housing 270 mounted at the top end 224*d* of gripping region 224*a* base 216. Housing 270 retains a third laser (not shown) that projects a beam of light 274 (FIG. 10) outwardly through an aperture 272 in housing 270. The third laser is oriented so that the laser beam 274 (FIG. 10) extends outwardly along the longitudinal axis "B" of device 210. Device 210 is configured to be positioned on a club 14 in the manner shown in FIG. 9, so that housing 270 is seated on the top end of the club. As shown in FIG. 10, when golfer 276 swings club 14 backwardly to strike the ball 278, the beam 274 of laser light falls on the practice mat 262 and gives the golfer a visual reference to determine if he has made his back-swing correctly and is correctly positioned to strike the ball 278. The golfer can track the pathway of laser beam 274 as he swings the club 14 forwardly to strike golf ball 278. Consistent use of device 210 and tracking of laser beam 274 can aid the golfer in correcting and perfecting his or her swing.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A golf training device for aiding in correct positioning of a golfer's hands, said training device being designed for engagement with a golf club that includes a club head at a first end of a shaft and a handle at a second end of the shaft, said training device comprising;

an elongated member having a longitudinal axis:

a proximal end;

a distal end;

a first and a second side edge extending between the proximal and distal ends; said first and second side edges being separated from each other by a longitudinal gap;

an interior surface extending from the proximal end to the distal end and between the first and second side edges, said interior surface being substantially arcuate in cross-sectional shape and configured to be complementary to a longitudinally aligned exterior portion of the handle of the club; and an exterior surface opposed to the interior surface, said exterior surface being configured to be grippingly engaged by a golfer;

a single protrusion extending outwardly away from the exterior surface proximate the proximal end of the elongated member;

a single aperture defined in the elongated member adjacent the protrusion and disposed between at least a portion of said protrusion and the distal end; and wherein the aperture is configured to receive the thumb of a golfer therein such that the thumb will contact the handle of the club; and a single groove provided in the exterior surface, said groove being disposed intermediate the aperture and the distal end of the elongated member.

2. The golf training device as defined in claim 1, wherein the elongated member is configured to clip onto a longitudinally aligned exterior portion of the handle of the club.

3. The golf training device as defined in claim 1, wherein the interior surface of the elongated member frictionally grips the handle of the club.

4. The golf training device as defined in claim 1, wherein the interior surface of the elongated member is substantially C-shaped and is configured to cover at least half of a circumferential outer surface of the handle.

5. The golf training device as defined in claim 1, wherein the interior surface of the elongated member includes a channel that is concave in cross-section and extends for substantially the entire length of the elongated member, and wherein all of the protrusion, the aperture and the groove are provided in a region of the exterior surface opposite the channel.

6. The golf training device as defined in claim 5, wherein the elongated member is made from a flexible material and the channel expands as it engages the handle of the golf club.

7. The golf training device as defined in claim 1, wherein the aperture is a substantially elongated oval shape and is substantially aligned with a longitudinal axis of the elongated member.

8. The golf training device as defined in claim 1, wherein the protrusion is substantially semicircular in shape and projects arcuately outwardly away from the exterior surface of the elongated member.

9. The golf training device as defined in claim 8, wherein the protrusion includes a substantially flat inner surface and an opposed outer surface; and wherein the inner surface is disposed a greater distance away from the first side edge than is the outer surface thereof.

10. The golf training device as defined in claim 9, wherein the protrusion has a length extending between the first and second ends thereof and has a width as measured between the inner and outer surfaces thereof, and wherein the width is substantially constant along the entire length of the protrusion.

11. The golf training device as defined in claim 1, wherein the single groove is disposed at an acute angle relative to the longitudinal axis of the elongated member and extends downwardly at an angle toward the distal end of the elongated member.

12. The golf training device as defined in claim 1, further comprising:

a pair of lasers mounted at the distal end of the elongated member, each laser being actuatable to emit a laser beam outwardly away from the distal end, and wherein said lasers are positioned such that said beams of laser light diverge outwardly away from each other and are configured to shine on either side of the head of the golf club.

13. The golf training device as defined in claim 12, further comprising a third laser mounted at the proximal end of the elongated member, said third laser being actuatable to emit a laser beam that extends outwardly away from the training device and substantially aligned with the longitudinal axis of the elongated member.

14. The golf training device as defined in claim 13, further comprising a housing disposed at the proximal end of the elongated member, said housing being disposed substantially at right angles to the longitudinal axis of the elongated member and being configured to rest on an upper end of the golf club remote from the club head; and wherein the third laser is mounted within the housing.

15. The golf training device as defined in claim 1, wherein the elongated member has a centerline that is substantially equidistant from each of the first and second side edges thereof; and wherein the protrusion and aperture extend in generally the same direction away from the centerline and toward one of the first and second side edges.

16. The golf training device as defined in claim 15, wherein the groove extends in generally the same direction away from the centerline and toward the same one of the first and second side edges as the protrusion and aperture.

17. The golf training device as defined in claim 1, wherein the elongated member is of a first thickness between the interior and exterior surfaces at the proximal end, and is of a second thickness between the interior and exterior surfaces at the distal end thereof; and wherein the second thickness is greater than the first thickness.

18. The golf training device as defined in claim 17, wherein a portion of the elongated member is of substantially the second thickness for a distance extending from the distal end and inwardly to a position intermediate the aperture and the groove.

19. The golf training device as defined in claim 1, wherein the distal end of the elongated member is substantially planar and is disposed generally orthogonal to the longitudinal axis of the elongated member.

20. The golf training device as defined in claim 1, wherein the elongate member further includes a housing disposed at the proximal end thereof; said housing being oriented so as to extend inwardly away from the interior surface of the elongated member; and wherein an inner surface of said housing is configured to abut an outermost end of the golf club handle when said interior surface abuts the handle of the golf club.

21. A golf training device for aiding in correct positioning of a golfer's hands, said training device being designed for engagement with a golf club that has a club head and a handle, said training device comprising;

an elongated member having a longitudinal axis:

a proximal end;

a distal end;

a first and a second side edge extending between the proximal and distal ends;

an interior surface extending from the proximal end to the distal end and between the first and second side edges, said interior surface being substantially arcuate in cross-sectional shape and configured to be complementary to a longitudinally aligned exterior portion of the handle of the club; and, an exterior surface opposed to the interior surface, said exterior surface being configured to be grippingly engaged by a golfer;

a single protrusion extending outwardly away from the exterior surface; said protrusion having a first end spaced a first distance inwardly away from the proximal end and remote from the distal end, and a second end spaced a second distance inwardly away from the proximal end;

a single aperture defined in the elongated member and extending between the interior and exterior surfaces thereof, said aperture being configured to receive the thumb of a golfer therein and having an origin end adjacent the protrusion and intermediate the first and second ends, and a termination end spaced a distance inwardly away from the second end of the protrusion and at a third distance from the proximal end of the elongated member, and a single groove provided in the exterior surface, said groove being disposed intermediate the termination end of the aperture and the distal end of the elongated member.

* * * * *